US010589530B2

(12) United States Patent
Choy et al.

(10) Patent No.: US 10,589,530 B2
(45) Date of Patent: Mar. 17, 2020

(54) PRINTER CARTRIDGE WITH MULTIPLE BACKPRESSURE CHAMBERS

(71) Applicant: HEWLETT-PACKARD DEVELOPMENT COMPANY, L.P., Houston, TX (US)

(72) Inventors: Silam J. Choy, Corvallis, OR (US); Steven T. Castle, Philomath, OR (US); Arun K. Agarwal, Corvallis, OR (US); Blair Kent, Camas, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/765,847

(22) PCT Filed: Oct. 28, 2015

(86) PCT No.: PCT/US2015/057823

§ 371 (c)(1),
(2) Date: Apr. 4, 2018

(87) PCT Pub. No.: WO2017/074354

PCT Pub. Date: May 4, 2017

(65) Prior Publication Data

US 2018/0281429 A1 Oct. 4, 2018

(51) Int. Cl.
*B41J 2/175* (2006.01)

(52) U.S. Cl.
CPC ..... *B41J 2/17513* (2013.01); *B41J 2/17523* (2013.01); *B41J 2/17553* (2013.01); *B41J 2/17556* (2013.01); *B41J 2202/21* (2013.01)

(58) Field of Classification Search
CPC ..... B41J 2/17513; B41J 2/17523; B41J 2/17553; B41J 2/17556; B41J 2002/21
See application file for complete search history.

(56) References Cited

U.S. PATENT DOCUMENTS

| | | | | |
|---|---|---|---|---|
| 5,509,140 | A | 4/1996 | Koitabashi | |
| 5,933,175 | A * | 8/1999 | Stathem | B41J 2/17506 347/87 |
| 6,364,474 | B1 * | 4/2002 | Chang | B41J 2/17503 347/86 |
| 7,284,848 | B2 | 10/2007 | Sugiyama | |
| 7,771,030 | B2 | 8/2010 | Fishbein | |

(Continued)

FOREIGN PATENT DOCUMENTS

| | | |
|---|---|---|
| CN | 101657331 | 2/2010 |
| CN | 103282209 | 9/2013 |

(Continued)

OTHER PUBLICATIONS

"HP 60 Inkjet Cartridge"; Sep. 16, 2015; <http://www.cartridgesupport.com/hp60inkjet.pdf>.

*Primary Examiner* — Sharon A. Polk

(57) ABSTRACT

In one example in accordance with the present disclosure a printer cartridge is described. The printer cartridge includes multiple backpressure chambers in fluid communication with a shared free fluid chamber. The backpressure chambers are to supply a fluid to nozzles of a portion of a fluidic ejection assembly and to provide backpressure to the nozzles of the fluidic ejection assembly during deposition of fluid onto a print medium.

20 Claims, 10 Drawing Sheets

(56) References Cited

U.S. PATENT DOCUMENTS

| | | | | |
|---|---|---|---|---|
| 8,348,397 | B2 * | 1/2013 | Coffey | B41J 2/19 347/84 |
| 8,496,319 | B2 | 7/2013 | Boyd | |
| 8,721,042 | B2 * | 5/2014 | Petruchik | B41J 2/14016 347/40 |
| 9,004,661 | B2 | 4/2015 | Means | |
| 9,090,082 | B2 | 7/2015 | Boyd | |
| 2003/0043240 | A1 | 3/2003 | Dowell | |
| 2005/0157024 | A1 | 7/2005 | Silverbrook | |
| 2007/0035596 | A1 | 2/2007 | Gray | |
| 2007/0076083 | A1 | 4/2007 | Gray et al. | |
| 2007/0229630 | A1 * | 10/2007 | Komplin | B41J 2/17513 347/87 |
| 2008/0259141 | A1 * | 10/2008 | Myers | B41J 2/17513 347/86 |
| 2010/0079559 | A1 | 4/2010 | Justice et al. | |
| 2011/0012945 | A1 | 1/2011 | Coffey | |
| 2013/0141497 | A1 | 6/2013 | Boyd | |
| 2015/0035915 | A1 | 2/2015 | Murphy | |

FOREIGN PATENT DOCUMENTS

| | | |
|---|---|---|
| CN | 104053548 | 9/2014 |
| WO | WO-2008130928 | 10/2008 |
| WO | WO-2012094012 | 7/2012 |

* cited by examiner

PRINTER CARTRIDGE WITH MULTIPLE BACKPRESSURE CHAMBERS

BACKGROUND

Printing systems are used to deposit printing fluid, such as ink, onto a print medium, such as paper. Fluid containers such as printer cartridges store the fluid that is used by other devices, such as printheads. A fluid delivery system transports the printing fluid from the fluid container to the printhead. The printhead of the printing system is a device of a printing system that deposits the ink or other printing fluid onto the print medium.

BRIEF DESCRIPTION OF THE DRAWINGS

The accompanying drawings illustrate various examples of the principles described herein and are a part of the specification. The illustrated examples are given merely for illustration, and do not limit the scope of the claims.

Throughout the drawings, identical reference numbers designate similar, but not necessarily identical, elements.

DETAILED DESCRIPTION

Figure 1:
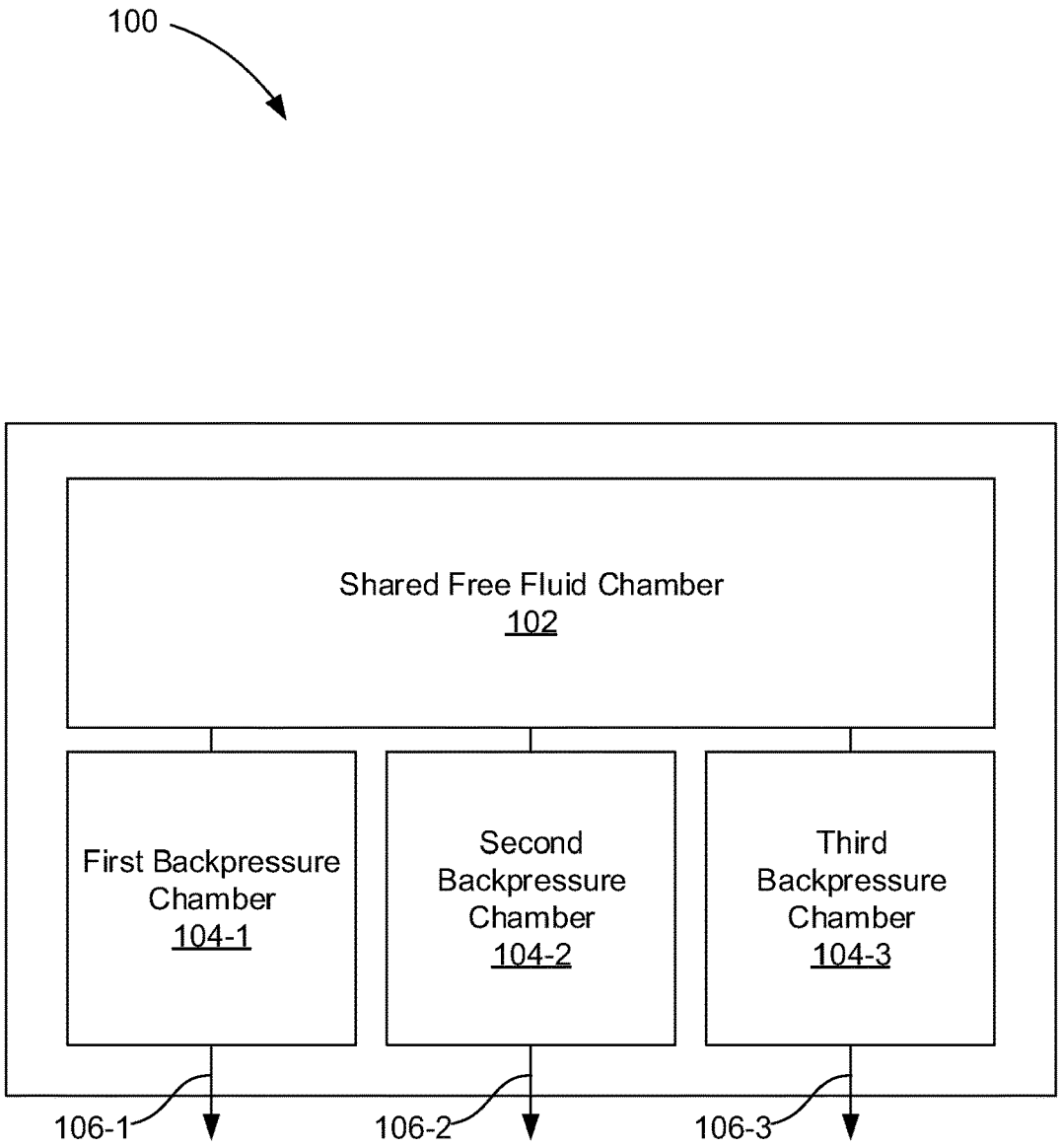
FIG. 1 is a block diagram of a printer cartridge with multiple backpressure chambers, according to one example of the principles described herein.

As described above, printer cartridges store fluid, such as ink that is to be supplied to other devices which fluid is ultimately deposited on a print medium. A printhead is an example of a device that is used to deposit ink, or other printing fluid onto a print medium such as paper. Printheads include printhead dies that have openings through which the printing fluid passes from the printing system onto the paper. Prior to ejection a small amount of printing fluid resides in a firing chamber of the printhead die, and an ejector such as a thermo-resistor or a piezo-resistive device creates pressure that forces a portion of the printing fluid from the firing chamber, through the opening, and onto the print medium. One particular type of printhead is a page wide printhead where an array of printhead dies spans the printing width of the print medium. While such printing systems are efficient in depositing ink, or other printing fluid, onto a print medium, some environments do not lend well to existing printing systems.

For example, as printing fluid is used, it is depleted from a fluid chamber and replaced with air. Due to changes in temperature and pressure, the air can expand and push ink out of the nozzles. To regulate this, a backpressure chamber may be used to prevent such drool. However, backpressure chambers suffer from some limitations. These limitations may be exacerbated when a printer cartridge is the same width as the page to be used with a page wide printhead. For example, due to its length, a page wide printhead, and a corresponding page wide printer cartridge is subject to greater head pressure due to the height of the page wide printer cartridge. In one example, this is most evident when a page wide printer cartridge is tipped on its side. Due to the length of the page wide printer cartridge, if the cartridge is oriented such that the long axis is vertical, then the potential head height pressure the nozzles see is much higher than a non-page wide system.

Printer cartridges may use a foam insert to generate the backpressure. To accommodate the increased head pressures, some printer cartridges use foams with smaller pore size to regulate backpressure. However, foams with such a smaller pore size reduce the flow rates and the smaller pore sizes may filter out color pigment and other desirable particulates in the printing fluid.

Still further, in printer cartridges, air inevitably is generated near the printhead and if sufficient air is generated, may block fluid flow and prevent printing. Filters such as foam inserts prevent air from going upstream. This is exacerbated in a page wide printhead as more air is generated relative to the printhead as air generation is proportional to the number of nozzles and as a page-wide printhead has more nozzles, more air is generated. If the page-wide cartridge is tilted, the air can migrate to one end of the cartridge and block flow of the printing fluid to an end printhead of the cartridge.

Other printer cartridges include separate backpressure chambers that deliver ink to each segment of the page wide printhead. However, doing so may reduce the volume of fluid available to each backpressure chamber. So to increase the volume of fluid available in a fluid container, additional backpressure chambers are added. Such additional chambers add cost and complexity to a fluid container.

Moreover, as a page wide printhead prints unevenly across the width of the print medium, the different backpressure chambers may deplete at different rates resulting in stranded ink in a chamber. This stranded ink is wasteful, results in lost revenue, and inefficient. Moreover uneven ink usage may lead to uneven printing on the print medium which leads to customer dissatisfaction.

The present specification describes a fluid container and system that alleviates these and other complications. More specifically, the fluid containers of the present specification include backpressure chambers that maintain a backpressure on the nozzles so as to prevent undesirable deposition of fluid onto a medium, even in a page wide printhead, and also reduce the occurrence of stranded print fluid and uneven printing. Specifically, the present specification describes multiple backpressure chambers in fluidic communication with a shared free fluid chamber. The multiple backpressure chambers accommodate the greater head pressures found in certain printing systems such as page wide printing systems. Moreover, as all the backpressure chambers are coupled to the same shared free fluid chamber, there is less likelihood of fluid accumulation at one part of the printing system thereby reducing the likelihood of stranded printing fluid and uneven printing as the printing fluid is evenly distributed amongst the multiple backpressure chambers.

Specifically, the present specification describes a printer cartridge. The printer cartridge includes multiple backpressure chambers in fluid communication with a shared free fluid chamber. A backpressure chamber supplies a fluid to nozzles of a portion of a fluidic ejection assembly and provides backpressure to the nozzles of the fluidic ejection assembly during deposition of fluid onto a print medium.

The present specification also describes a printer cartridge that includes a shared free fluid chamber. The cartridge also includes a fluid delivery system in fluid communication with the shared free fluid chamber to deliver fluid from the shared free fluid chamber to a fluid ejection assembly. The fluid delivery system includes multiple backpressure chambers in fluid communication with the shared free fluid chamber to supply fluid to the fluidic ejection assembly and to provide backpressure to the fluid during deposition of the fluid onto a print medium. A backpressure chamber includes an outlet to pass fluid from the backpressure chamber to a corresponding portion of the fluidic ejection device. The fluid delivery system also includes multiple ports disposed between the shared free fluid chamber and the multiple backpressure chambers to regulate flow of fluid between the free fluid chamber and the multiple backpressure chambers.

The present specification also describes a fluid containment system. The fluid containment system includes a number of fluid containers. Each fluid container includes a number of shared free fluid chambers and a number of backpressure chambers. A set of the backpressure chambers are in fluid communication with one of the number of shared free fluid chambers. A fluid container of the system is the same width as a print medium on which fluid from the fluid container is deposited.

Certain examples of the present disclosure are directed to fluid containers and systems using multiple backpressure chambers that provides a number of advantages not previously offered including 1) accommodating greater head pressures found in certain print heads; 2) allowing for larger fluid container design; and 3) reducing stranded fluid caused by uneven printing along a page wide print head. However, it is contemplated that the devices and methods disclosed herein may prove useful in addressing other deficiencies in a number of technical areas. Therefore the systems and devices disclosed herein should not be construed as addressing just the particular elements or deficiencies discussed herein.

As used in the present specification and in the appended claims, the term "shared" refers to a free fluid chamber that supplies fluid to multiple backpressure chambers.

Further, as used in the present specification and in the appended claims, the term "free" or similar terminology refers to fluid that is not subject to an imposed pressure.

Still further, as used in the present specification and in the appended claims, the term "a number of" or similar language is meant to be understood broadly as any positive number including 1 to infinity; zero not being a number, but the absence of a number.

In the following description, for purposes of explanation, numerous specific details are set forth in order to provide a thorough understanding of the present systems and methods. It will be apparent, however, to one skilled in the art that the present apparatus, systems, and methods may be practiced without these specific details. Reference in the specification to "an example" or similar language indicates that a particular feature, structure, or characteristic described in connection with that example is included as described, but may not be included in other examples.

Turning now to the figures, FIG. 1 is a block diagram of a printer cartridge (100) with multiple backpressure chambers (104-1, 104-2, 104-3), according to one example of the principles described herein. As described above, a printer cartridge (100) is used to supply fluid to a device that expels the fluid onto a print medium. For example, the fluid may be ink and the printer cartridge (100) may be an ink container that supplies the ink to a printhead which printhead deposits the ink onto a print medium to form text or images. The printer cartridge (100) is usable in an image forming device such as a printer.

The printer cartridge includes a number of backpressure chambers (104-1, 104-2, 104-3) that are in fluid communication with a shared free fluid chamber (102). As used in the present specification, the identifier "-*" refers to a specific instance of an element. For example (104-1) refers to a first backpressure chamber (104-1). By comparison, elements without the identifier "-1" refer to a generic instance of an element. For example, (104) refers to backpressure chambers in general. The backpressure chambers (104) provide backpressure to the nozzles of the fluidic ejection assembly during deposition of fluid onto a print medium. Backpressure counters the effect of gravity in a nozzle. For example, due to the effects of gravity any fluid above the nozzles will want to come out. Backpressure is used to overcome the force of gravity to keep the fluid in the printer cartridge (100). The backpressure provided may also be less than a certain value. For example, if the backpressure is too great the system can undergo a "gulping" action where air is pulled in through the nozzle, which also affects printing. In other words, the backpressure prevents drool and also remains at a magnitude less than the value of this maximum value.

The backpressure also manages environmental changes. For example, increasing temperature will pressurize any air in an enclosed volume. Decreasing external pressure will at some point produce a situation where the pressure inside the volume will be greater than the pressure outside thereby allowing ink to leak out the nozzles. The backpressure provided accommodates these environmental changes again to prevent ink from dripping out of the nozzles. The backpressure chambers (104) also prevent fluid from dripping out the nozzles when the image forming apparatus is not operating.

The backpressure chambers (104) are independently regulated meaning that the backpressure afforded by a first backpressure chamber (104-1) is not dependent upon the backpressure afforded by a second backpressure chamber (104-2). Independently regulated backpressure chambers (104) reduce the static pressure needed and allows for larger pore sizes in a foam insert for example.

In some examples, the printer cartridge (100) is a page wide fluid container for use with a page wide printhead. The page wide printer cartridge (100) is the same width, or slightly smaller or slightly larger than the print medium to accommodate a margin or other components of the printing system. In this example, the multiple backpressure chambers (104) are arranged in an array and the array is the same width as the print medium on which fluid is deposited. For example, if printed on a letter-sized paper being 8.5 inches wide, the array of chambers (104) may also be 8.5 inches wide. While FIG. 1 depicts three backpressure chambers (104), the printer cartridge (100) may include any number of backpressure chambers (104).

Each of the backpressure chambers (104) supplies a printing fluid such as ink to nozzles of a portion of a fluidic ejection assembly. For example, when used in an image forming apparatus, the printer cartridge (100) may be placed in fluid communication with a fluidic ejection assembly such as a printhead. The printhead includes a number of components to deliver ink onto a print medium. For example a printhead includes printhead dies which each include nozzles to deposit an amount of fluid onto the print medium. In this example, each backpressure chamber (104) supplies fluid to different printhead die(s) of the printhead. For example, the first backpressure chamber (104-1) supplies fluid to a first set of printhead die(s) as indicated by the arrow (106-1) which first set may include any number starting from and including one. Similarly, the second backpressure chamber (104-2) and the third backpressure chamber (104-3) supply fluid to a second set of printhead die(s) and a third set of printhead die(s) as indicated by the arrows (106-2) and (106-3), respectively.

The shared free fluid chamber (102) supplies fluid to multiple backpressure chambers (104). The shared free fluid chamber (102) allows for printer cartridges (100) that hold more fluid and also alleviates uneven printing as each of the backpressure chambers (104) draw fluid from the shared free fluid chamber (102) thus alleviating the condition where the different backpressure chambers (104) deplete at different rates. In conjunction with the multiple backpressure chambers (104) which accommodate the head pressures that exist in a page wide printing system, the shared free fluid chamber (102) implements a system that is well suited for supplying large amounts of ink to a page wide printing system all while maintaining a sufficient backpressure to accommodate even fluid distribution and reducing the occurrences of stranded fluid in a page wide printhead.

Still further, by segmenting the backpressure chambers (104), the effective maximum head height experienced by nozzles in a page-wide printhead is no longer the full length of the printer cartridge (100) but is rather the length of the individual backpressure chambers (104). Moreover, segmentation of the backpressure chambers (104) alleviates the issue of an increased air intake described above in relation to the page-wide printhead.

Figure 2A:
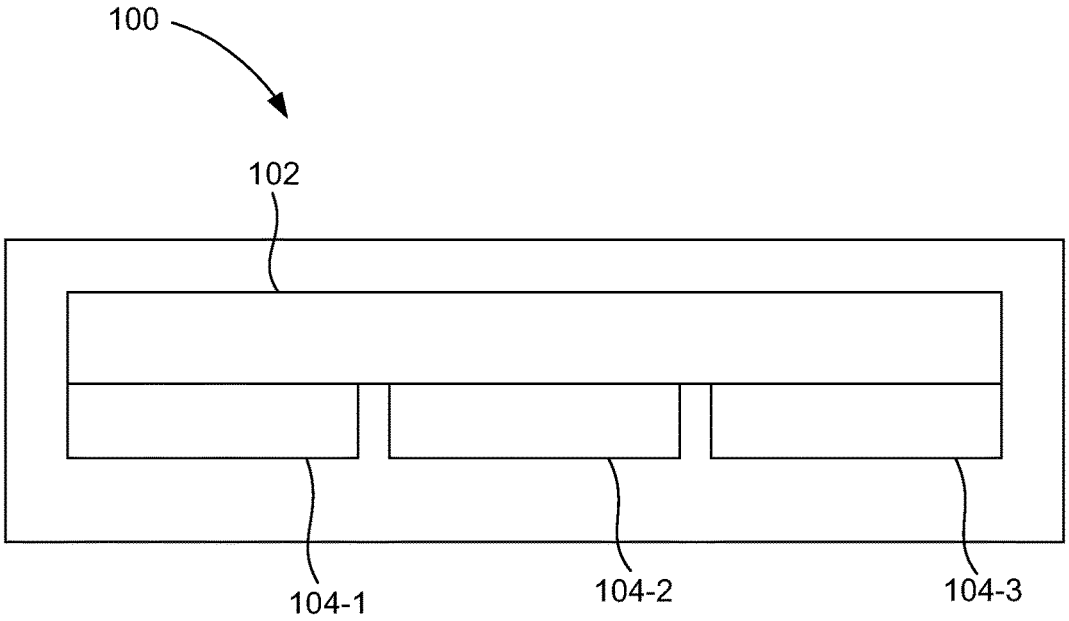
FIGS. 2A-2C are cross-sectional views of a printer cartridge with multiple backpressure chambers, according to one example of the principles described herein.
Figure 2B:
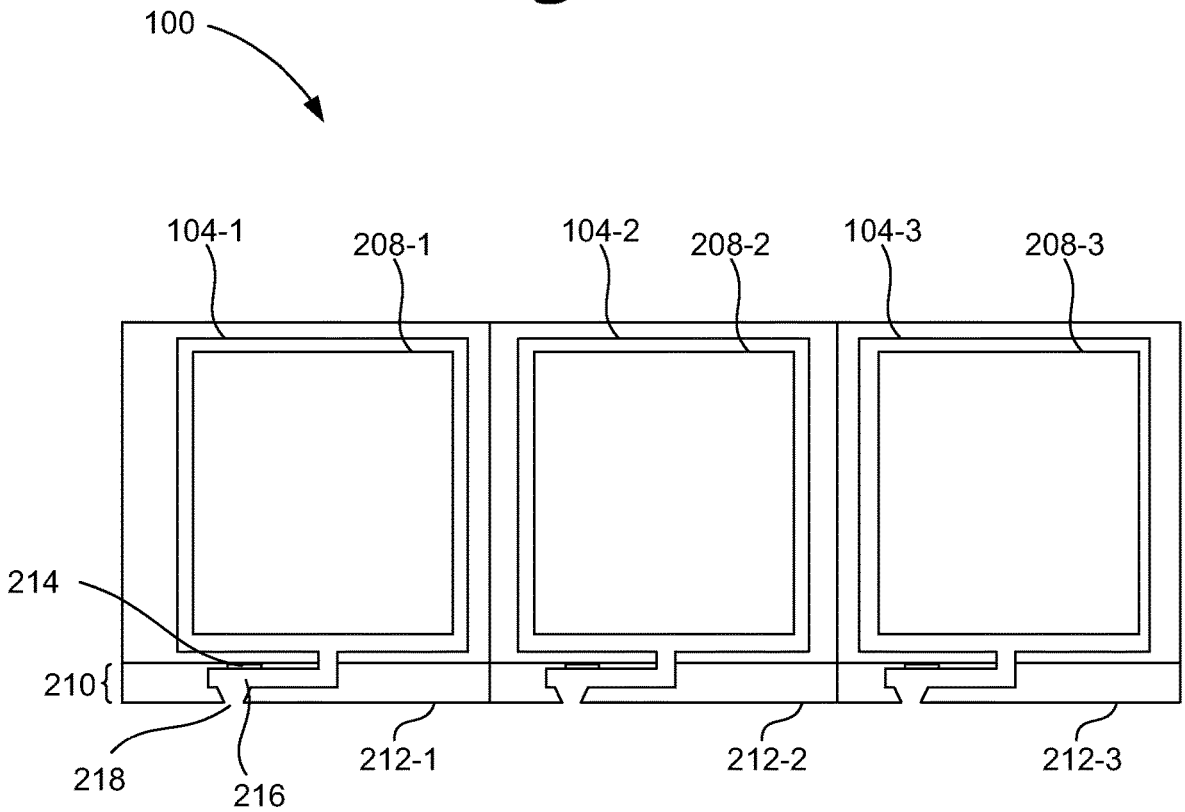
Figure 2C:
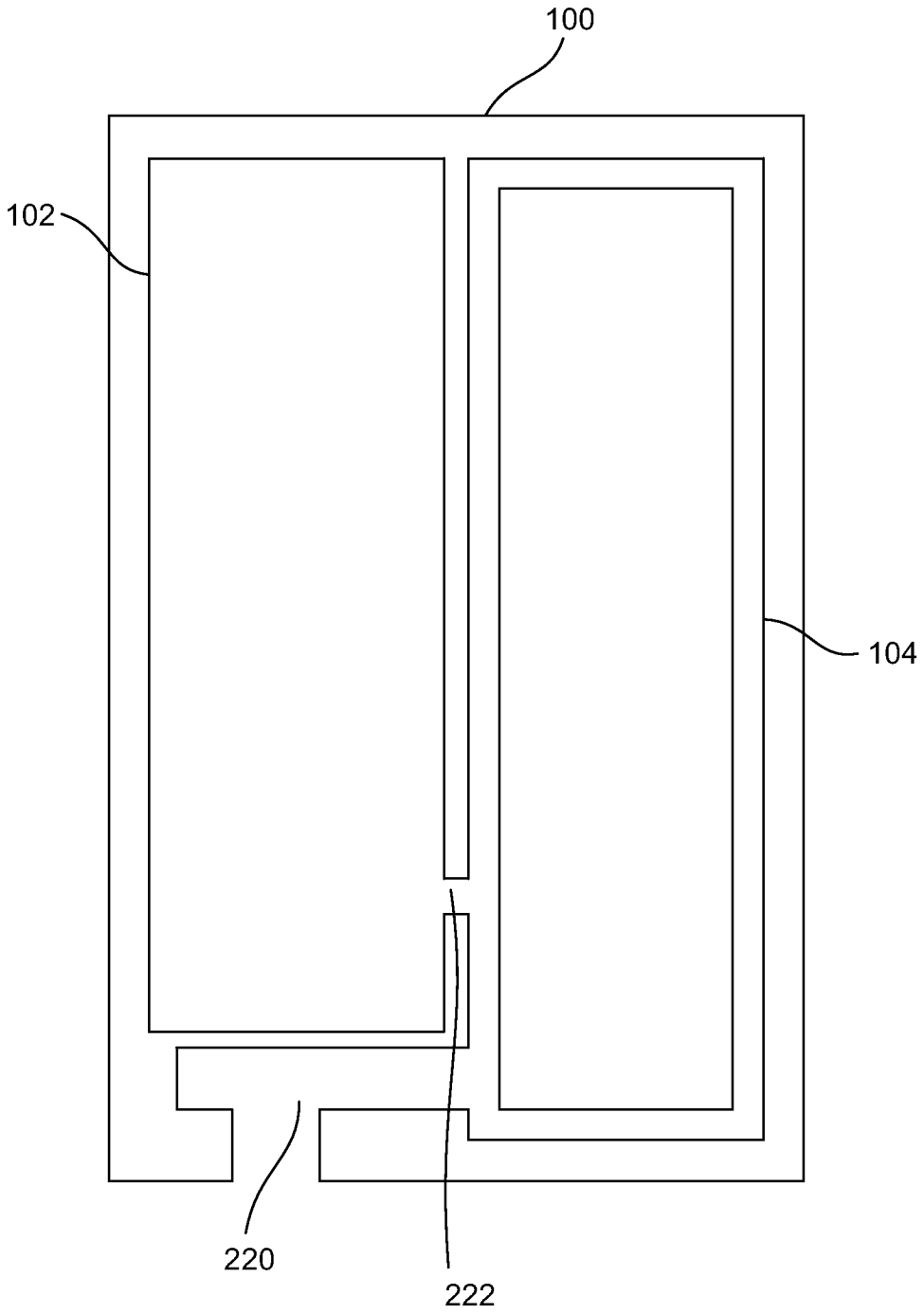

FIGS. 2A-2C are cross-sectional views of a printer cartridge (100) with multiple backpressure chambers (104), according to one example of the principles described herein. Specifically, FIG. 2A depicts a top view of the printer cartridge (100). As depicted in FIG. 2A, the shared free fluid chamber (102) is in fluid communication with multiple backpressure chambers (104-1, 104-2, 104-3). In other words the fluid stored in each backpressure chamber (104) is supplied by the same free fluid chamber (102), thus alleviating a condition where an amount of fluid supplied to one backpressure chamber, i.e., the first backpressure chamber (104-1) is depleted before another backpressure chamber (104-2) as the multiple backpressure chambers (104) receive their fluid from the same supply. As described above, in some examples, the printer cartridge (100) is a page wide printer cartridge (100) meaning that at least one of 1) the shared free fluid chamber (102) or 2) the array of multiple backpressure chambers (104) are at least the same length as the print medium on which fluid is deposited and may be larger to accommodate other components such as electrical connects, housing walls etc.

FIG. 2B is a front cross-sectional view of the printer cartridge (100). In this example, the shared free fluid chamber (102) is not visible as it is behind the multiple backpressure chambers (104). As described above, the backpressure chambers (104) supply a backpressure to the nozzles to prevent fluid from flowing out of the nozzles when it is undesirable to do so, for example when the printing system is not printing. Accordingly, in some examples, the backpressure chambers (104) may include a foam insert (208-1, 208-2, 208-3) within each backpressure chamber (104-1, 104-2, 104-3), respectively. The foam insert (208) controls backpressure by capillary action of the foam pores. The capillary pressure is an interaction of ink-foam material interface properties (i.e., ink surface tension and contact angle) and the diameter of the pores. Even though fluid can be drawn from the foam insert (208), the foam insert (208) continues to hold fluid and maintain a sufficient backpressure to prevent drool. In some examples, the foam insert (208) is vented to atmosphere to eliminate gas pressure effects from an enclosed volume.

In some examples, the printer cartridge (100) is integrated with a printhead (210). In other words, the printer cartridge (100) and the printhead (210) may be produced as a single component. In some examples, the integrated printer cartridge (100) and printhead (210) may be sold as a single component as opposed to being sold individually. The printhead (210) includes a number of components for depositing a fluid onto a surface. For example, the printhead (210) includes a number of printhead dies (212-1, 212-2, 212-3). Each printhead die (212) includes a number of nozzles. The nozzles of the printhead dies (212) may be arranged in columns or arrays such that properly sequenced ejection of fluid from the nozzles causes characters, symbols, and/or other graphics or images to be printed on the print medium. In one example, the number of nozzles fired may be a number less than the total number of nozzles available and defined on the printhead (210). As described above, each backpressure chamber (104) may correspond to a different printhead die (212), or in other words a different portion of the printhead (210).

In an example where the fluid is an ink, a first subset of nozzles may eject a first color of ink while a second subset of nozzles may eject a second color of ink. Additional groups of nozzles may be reserved for additional colors of ink. To create an image, at appropriate times, electrical signals passed to the printhead (210) that cause the printhead (210) to eject small droplets of fluid from the nozzles onto the surface of the print medium. These droplets combine to form an image on the surface of the print medium. As used in the present specification and in the appended claims, the print medium may be any type of suitable sheet or roll material, such as paper, card stock, transparencies, polyester, plywood, foam board, fabric, canvas, and the like. In another example, the print medium may be an edible substrate.

Returning to the printhead die (212), a printhead die (212) includes a number of nozzles to deposit an amount of fluid onto a print medium. The nozzles may be arranged in rows, columns, or other forms of arrays to deposit the fluid onto a print medium. For simplicity one nozzle per backpressure chamber (104) is indicated however any number of nozzles in any orientation may be in fluidic communication with a corresponding backpressure chamber (104). Each nozzle includes a firing chamber (216) to hold an amount of fluid received from the corresponding backpressure chambers (104) to be dispensed out an opening (218).

A printhead die (210) also includes an ejector (214) to eject the amount of fluid through the opening (218). For simplicity, in FIG. 2B one instance of certain components are identified with a reference number. The ejector (4) may include a firing resistor or other thermal device, a piezoelectric element, or other mechanism for ejecting fluid from the firing chamber (216). For example, the ejector (214) may be a firing resistor. The firing resistor heats up in response to an applied voltage. As the firing resistor heats up, a portion of the fluid in the firing chamber (216) vaporizes to form a bubble. This bubble pushes liquid fluid out the opening (218) and onto the print medium. As the vaporized fluid bubble pops, a vacuum pressure within the firing chamber (216) draws fluid into the firing chamber (216) from the fluid supply, and the process repeats. In this example, the printhead (210) may be a thermal inkjet printhead (210).

In another example, the ejector (214) may be a piezoelectric device. As a voltage is applied, the piezoelectric device changes shape which generates a pressure pulse in the firing chamber (216) that pushes a fluid out the opening and onto the print medium. In this example, the printhead (210) may be a piezoelectric inkjet printhead.

FIG. 2C is a side cross-sectional view of the printer cartridge (100) with multiple backpressure chambers (104), according to one example of the principles described herein. As described the printer cartridge (100) includes a shared free fluid chamber (102). The printer cartridge (100) also includes a fluid delivery system that includes multiple backpressure chambers (104). As FIG. 2C is a side view one backpressure chamber (104) is visible. The pressure is regulated in the fluid chamber (104) via some pressure-regulating component. In the example depicted in FIG. 2C, the pressure-regulating component is the foam insert (208) that, via capillary action, provides backpressure to the fluid during deposition of the fluid onto the print medium.

The backpressure chamber (104) also includes an outlet (220) to pass fluid from the backpressure chamber (104) to a corresponding portion of the fluidic ejection device, or in other words to a corresponding number of printhead dies (FIG. 2, 212) of the printhead (FIG. 2, 210).

The fluid delivery system also includes a number of ports (222) disposed between the shared free fluid chamber (102) and the multiple backpressure chambers (104) to regulate the flow of fluid between the free fluid chamber (102) and the multiple backpressure chambers (104). The number of ports (222) may correspond to the number of backpressure chamber (104) with a port (222) used for each backpressure chamber (104). The ports (222) open once air reaches the port (222). As air reaches the port (222), ink is released from the shared free fluid chamber (102) to the corresponding backpressure chamber (104). In other words, a foam insert (208) that is full of ink seals the port (222), preventing air from reaching it. The port (222) may be at a height below the full height of the foam insert (208). When the foam insert (208) is full of ink, ink is covering the port (222) and preventing air in the backpressure chamber (104) from entering the free ink chamber (102). As ink is drained from the foam insert (208), the port (222) is eventually exposed, allowing air to enter the free ink chamber (102) and allowing the same volume of ink to exit the free ink chamber (102) and enter the foam insert (208).

Figure 3:
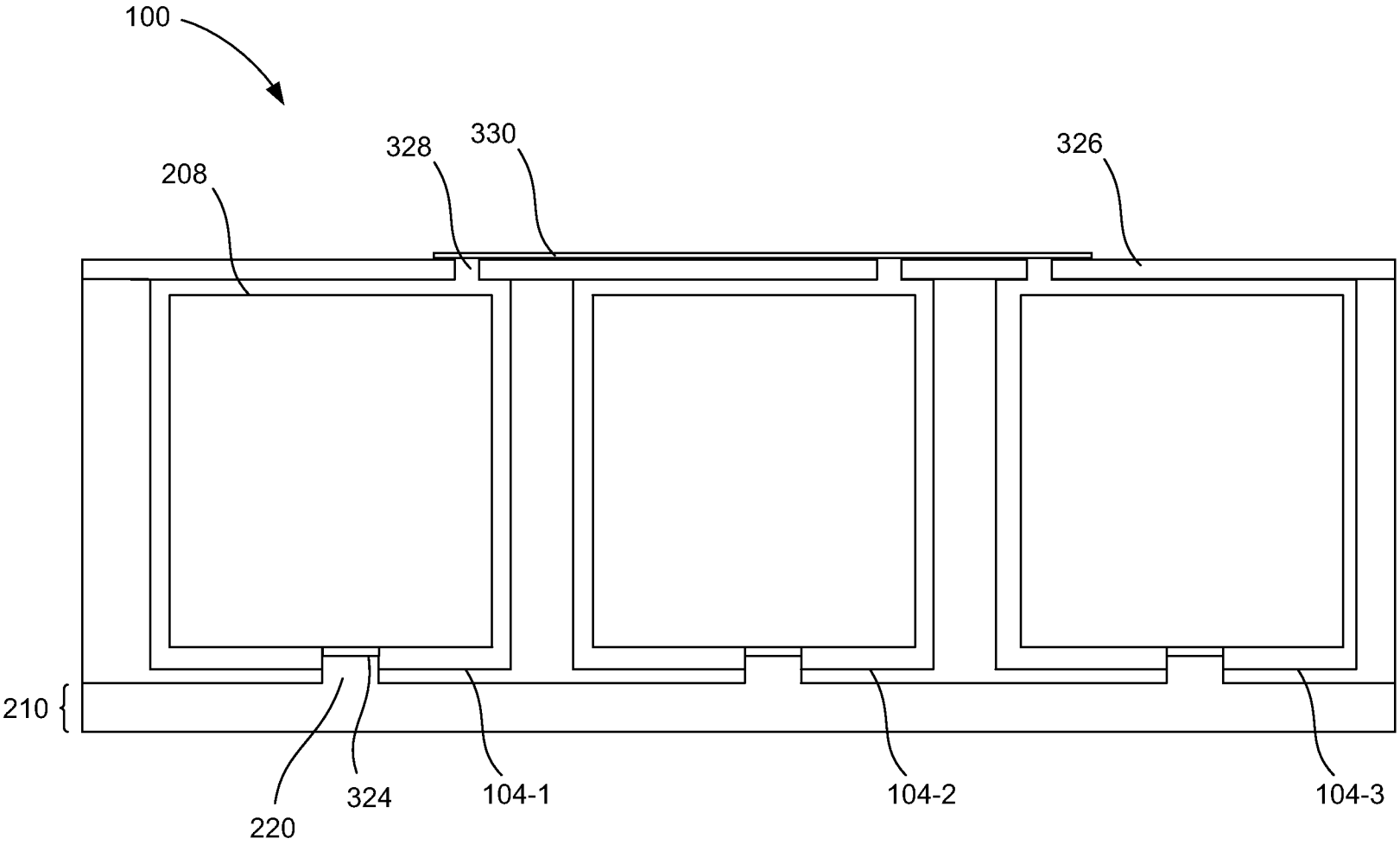
FIG. 3 is a front cross-sectional view of a printer cartridge with multiple backpressure chambers, according to another example of the principles described herein.

FIG. 3 is a front cross-sectional view of a printer cartridge (100) with multiple backpressure chambers (104), according to another example of the principles described herein. For simplicity, details regarding the components of the printhead (210) are omitted, however, the printhead (210) as depicted in FIG. 3 may be similar to the printhead (210) depicted in other figures contained herein. In the example depicted in FIG. 3, the pressure within a backpressure chamber (104) is regulated via a foam insert (208) placed in each backpressure chamber (104).

As described above, each backpressure chamber (104) includes an outlet (220). For simplicity one outlet (220) in FIG. 3 is depicted with a reference number. A filter (324) may be placed at the opening (220) of the backpressure chambers (104) to prevent contaminants, or other nozzle-blocking particles from passing to the printhead (210).

The fluid container (100) also includes a lid (326) to protect the fluid container (100) from contamination and to prevent ink from exiting the chambers. The lid (326) may include passageways (328) to allow a bag inside a backpressure chamber (104) to inflate, to allow a foam chamber to be at ambient atmospheric pressure, allow ink to drain during printing, and allow air to bubble through a check valve in a spring-bag system, among other reasons. The passageway (328) may be a labyrinth to limit water vapor loss out of the passageway through diffusion. Accordingly, a film (330) is placed over the passageways (328). The film includes a labyrinth that allows for precise establishment of a desired interior pressure for the backpressure chambers (104).

Figure 4:
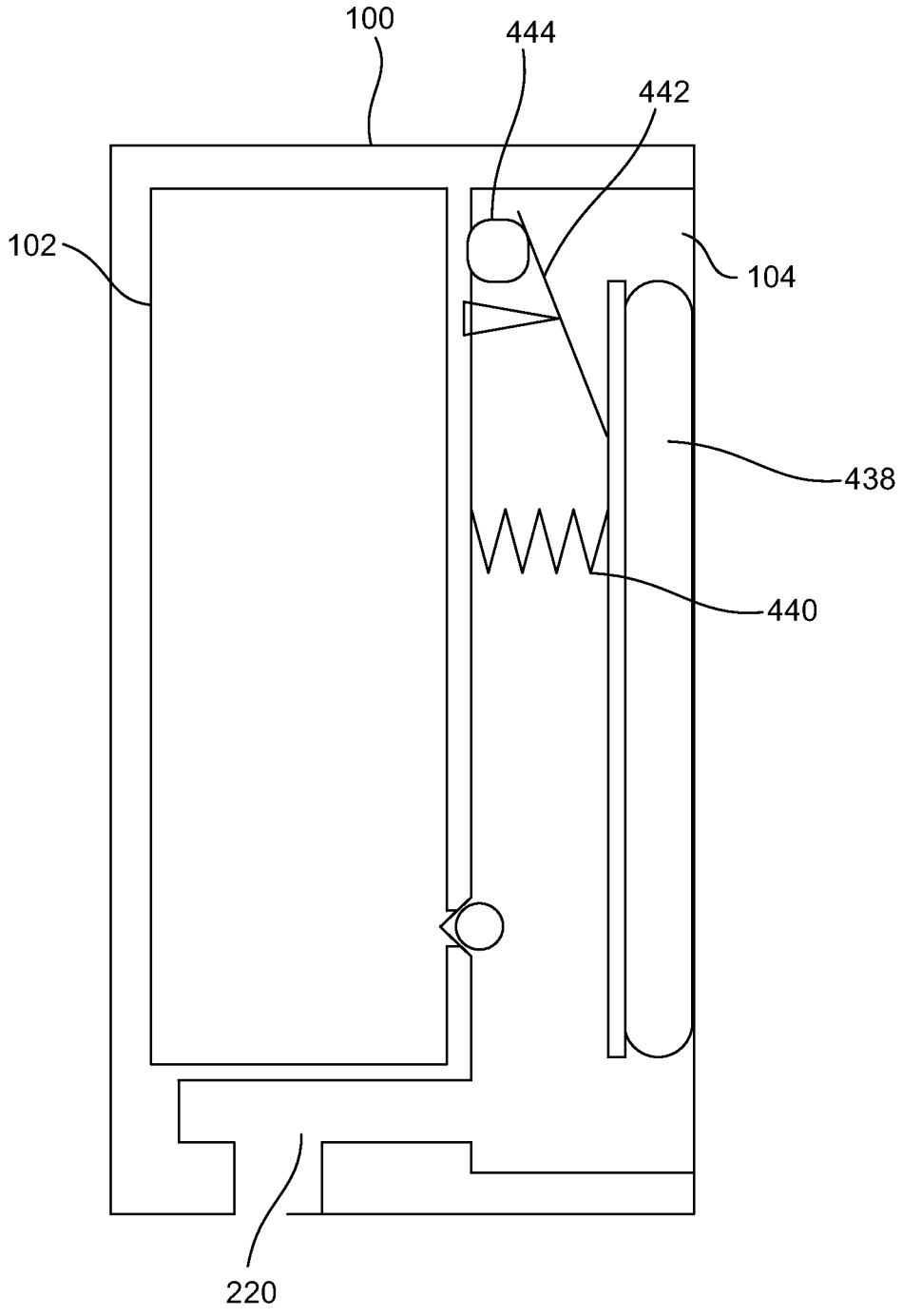
FIG. 4 is a side cross-sectional view of a printer cartridge with multiple backpressure chambers, according to another example of the principles described herein.

FIG. 4 is a side cross-sectional view of a printer cartridge (100) with multiple backpressure chambers (104), according to another example of the principles described herein. FIG. 4 also depicts the shared free fluid chamber (102) and the outlet (220) from the backpressure chamber (104) to the fluid ejection assembly or printhead (FIG. 2, 210). In the example depicted in FIG. 4, the backpressure chamber (104) includes a spring-compliant wall to regulate pressure within the backpressure chamber (104). In a spring-compliant wall assembly, a wall (438) is exposed to atmospheric pressure and the backpressure chamber (104) is enclosed. A spring (440) continually applies pressure on the wall (438). The spring force of the spring (440) pushes against the wall (438). As ink is depleted from the backpressure chamber (104), pressure in the backpressure chamber (104) becomes more negative until the nozzles can no longer refill and no drop ejection occurs. As the ink volume in the backpressure chamber (104) reduces, the wall (438) expands. As the wall (438) expands to a certain point a lever (442) connected to a valve (444) is actuated. When actuated, the valve (444) allows atmospheric air to enter the shared free fluid chamber (102) and also allows ink to flow from the shared free fluid chamber (102) into the backpressure chamber (104). As the air enters, pressure again grows and the wall (438) shrinks until the valve (444) is no longer actuated.

Figure 5:
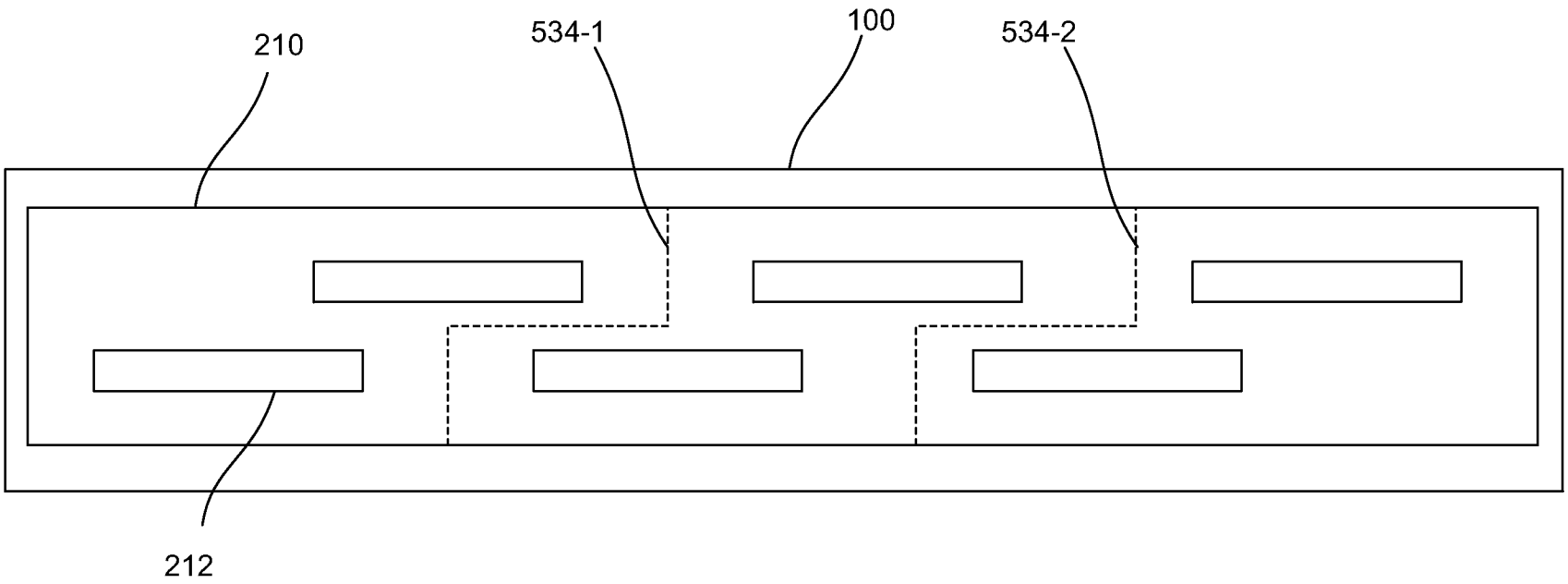
FIG. 5 is a diagram of a printhead used with the printer cartridge with multiple backpressure chambers, according to one example of the principles described herein.

FIG. 5 is a diagram of a printhead (210) used with the printer cartridge (100) with multiple backpressure chambers (FIG. 1, 104), according to one example of the principles described herein. As described above, the printer cartridge (100) and/or the printhead (210) which is used with the printer cartridge (100) may be at least the same length as the print medium. For example, when printing on media that is 8.5 inches wide by 11 inches long, the printer cartridge (100) and/or the printhead (210) may be 8.5 inches wide. In this example, the shared free fluid chamber (FIG. 1, 102) may similarly be at least the same length as the print medium. A page-wide printhead (210) alleviates lateral movement of either the print medium or the printhead (210) when depositing printing fluid onto the print medium. This reduces the likelihood of breakdown due to the mechanical devices that would otherwise be used to move the printhead (210). Page wide printheads are also valued for their speed. The advancement of the paper and printhead may be a laborious and time-consuming process. A page wide printhead may alleviate these processes. The examples shown in the corresponding figures are not meant to limit the present description. Instead, various types of printheads (210) may be used in conjunction with the principles described herein.

Similarly, as described above, the multiple backpressure chambers (FIG. 1, 104) may supply fluid to a portion of the printhead (210). More specifically, a particular backpressure chamber (FIG. 1, 104) may supply fluid to less than all of the print dies (212) on the printhead (210). For simplicity one print die (212) in FIG. 5 is indicated with a reference number. As depicted in FIG. 5, a first backpressure chamber (FIG. 1, 104-1) supplies ink to print dies (212) in a first portion of the printhead (210), which first portion is identified to the left of the first dashed line (534-1). Similarly, a second backpressure chamber (FIG. 1, 104-2) supplies fluid to print dies (212) in a second portion of the printhead (210), which second portion is identified between the first dashed line (534-1) and the second dashed line (534-2). Similarly, a third backpressure chamber (FIG. 1, 104-3) supplies fluid to print dies (212) in a third portion of the printhead (210) which third portion is identified to the right of the second dashed line (534-2). While FIG. 5 depicts three portions, any number of backpressure chambers (FIG. 1, 104) may supply fluid to any number of printhead dies (212).

As stated above, using the multiple backpressure chambers (FIG. 1, 104) allows for a backpressure regulation scheme that accommodates the higher head pressures that can occur in page wide array printing systems. Moreover, using a shared free fluid chamber (FIG. 1, 102) to supply fluid to multiple backpressure chambers (FIG. 1, 104) allows for unified printing and reduces the undesirable consequences of stranded ink.

FIGS. 6A-6D are diagrams of a fluid containment system (636) with multiple backpressure chambers (104), according to one example of the principles described herein. Specifically, FIGS. 6A-6D are side cross-sectional views of the fluid containment system (636). The fluid containment system (636) and more specifically the individual printer cartridges (100) may be the same width as the print medium on which fluid from the fluid containment devices are deposited.

The fluid containment system (636) includes a number of printer cartridges (100-1, 100-2, 100-3, 100-4). In the system (636) each of the printer cartridges (100) may correspond to a different printing color such as yellow, cyan, magenta, and black. Each of the printer cartridges (100) includes a shared free fluid chamber (102) and a number of backpressure chambers (104). For simplicity a few instances of each component is identified with a reference number. A set of backpressure chambers (104) are in fluid communication with one of the number of shared free fluid chambers (102). For example, backpressure chambers (104) that correspond to the yellow fluid container (100-1) are in fluid communication with the shared free fluid chambers (102) that correspond to the yellow fluid container. As depicted in FIGS. 6A-6D, the backpressure chambers (104) include a foam insert (208), but the backpressure chambers (104) may be pressure-regulated using any type of pressure-regulating component including the spring-compliant wall assembly described earlier.

Figure 6A:
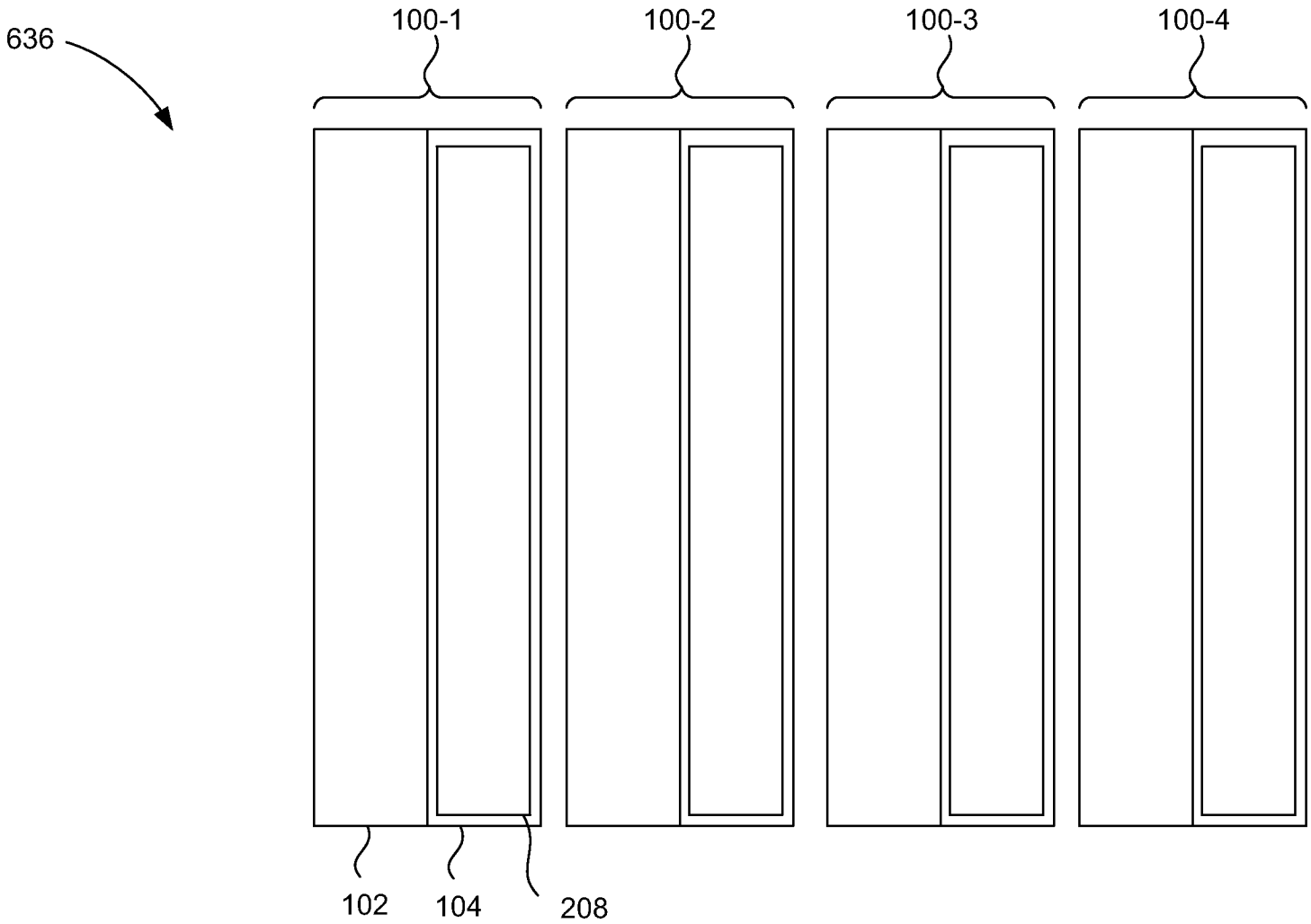
FIGS. 6A-6D are diagrams of a fluid containment system with multiple backpressure chambers, according to one example of the principles described herein.

As depicted in FIG. 6A, the backpressure chambers (104) may be separated from a corresponding shared free fluid chamber (102) by a vertical wall. The vertical wall may include a port (FIG. 2, 222) as described above. In the example depicted in FIG. 6A, each of the printer cartridges (100) may be removed and replaced vertically from the system (636).

Figure 6B:
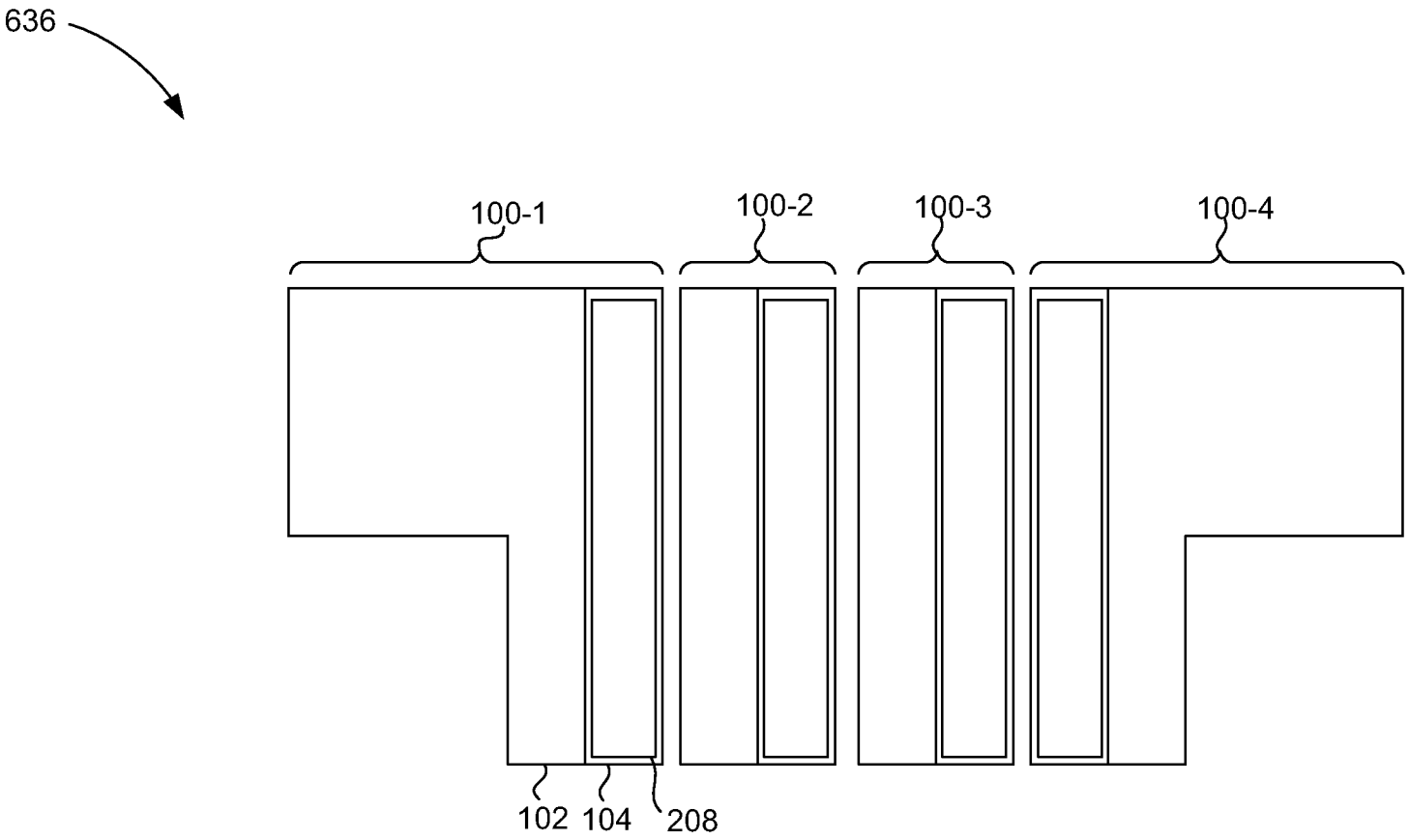

FIG. 6B depicts a system (636) wherein at least one of the printer cartridges (100-1, 100-4) has a non-rectangular cross section. Specifically, the first printer cartridge (100-1) and the fourth printer cartridge (100-4) do not have rectangular cross sections. Doing so may allow for even more fluid to be stored in the printer cartridge (100), for example for colors of fluid that may be more often used. Still further as depicted in FIG. 6B different printer cartridges (100) may have different cross-sectional shapes. FIG. 6B also depicts different printer cartridges (100) having different sizes. For example, those printer cartridges (100-1, 100-4) that have different cross-sectional areas have different sizes. In the example depicted in FIG. 6B, the printer cartridges (100) may still be removed and replaced vertically.

Figure 6C:
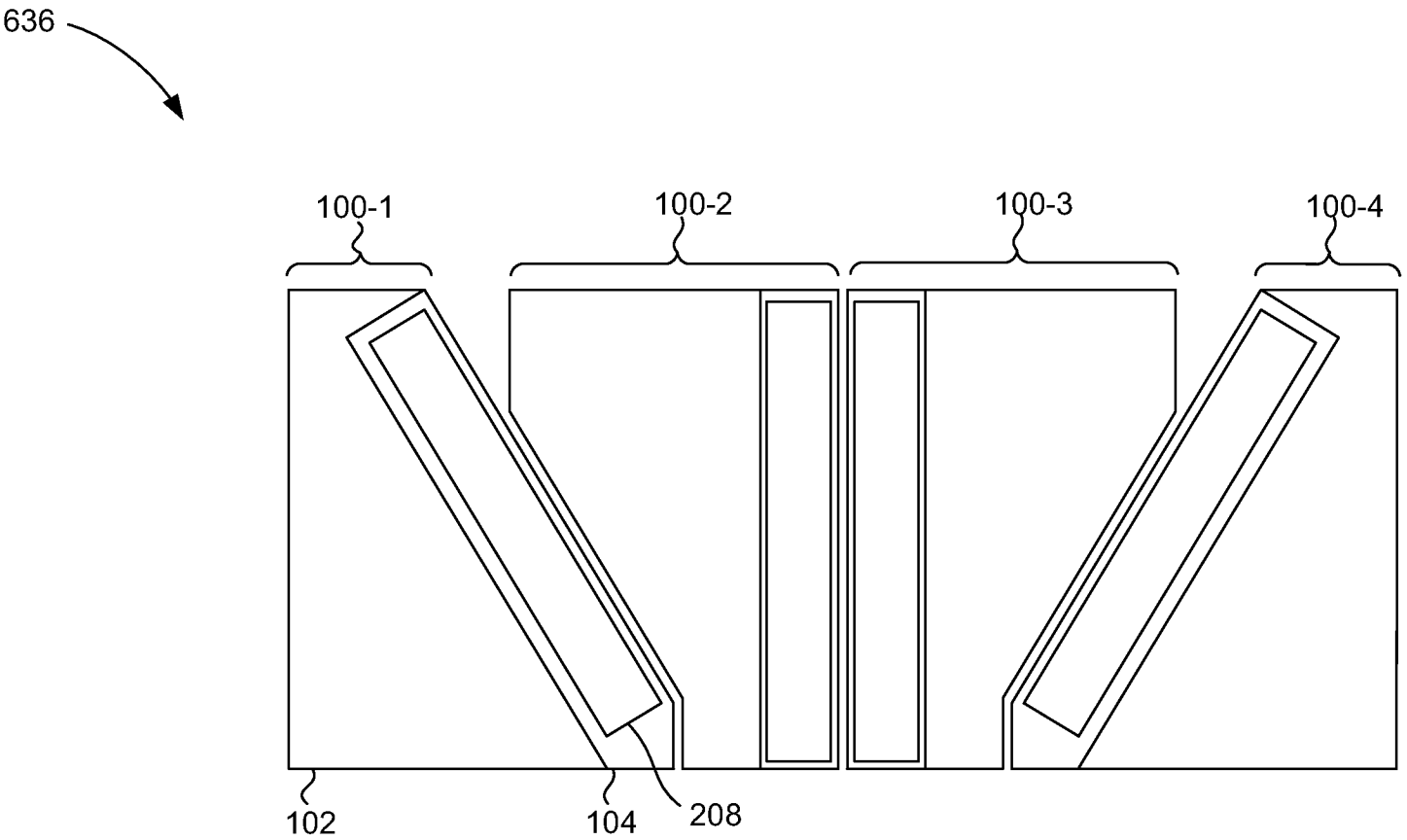

FIG. 6C is yet another example of the system (636) with printer cartridges (100) having different cross-sectional shapes and sizes. As depicted in FIG. 6C some of the printer cartridges (100) may be non-orthogonal meaning the cross-sectional area of the printer cartridges (100) is not made up exclusively of right angles. In this example, some printer cartridges (100), for example, the printer cartridges in the middle (100-2, 100-3) may be removed vertically while others, for example, the outer printer cartridges (100-1, 100-4) may be removed at an angle. Still further, the non-orthogonal printer cartridges (100) may have horizontal insertion and removal axes.

Figure 6D:
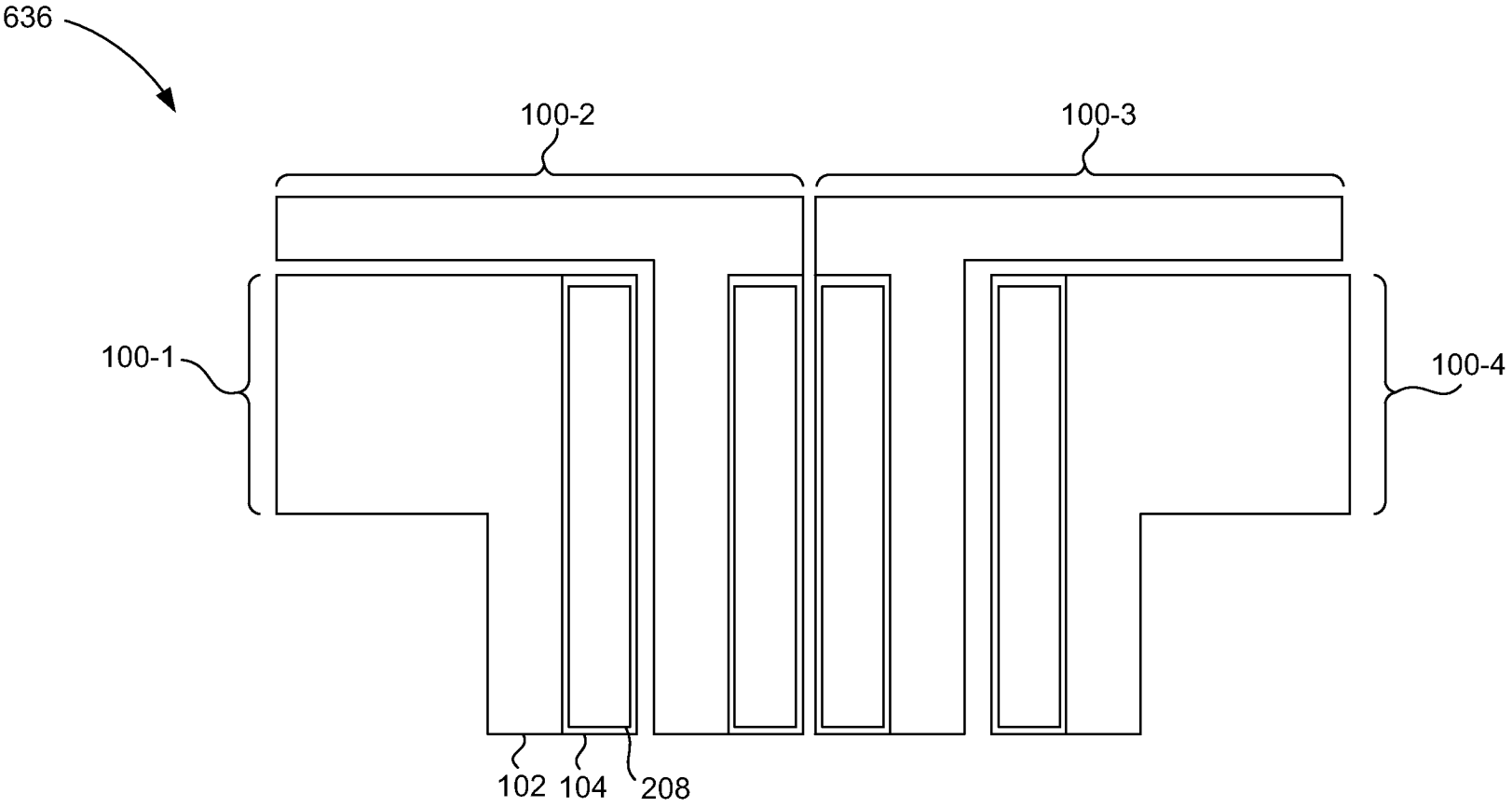

FIG. 6D is yet another example of the system (636) with printer cartridges (100) having different cross-sectional shapes and sizes. As depicted in FIG. 6D, the design of some of the printer cartridges (100) may allow for horizontal removal of other printer cartridges (100). While FIGS. 6A-6D depict particular cross-sectional areas and shapes, various cross-sectional shapes and sizes may be implemented in accordance with the principles described herein.

Certain examples of the present disclosure are directed to fluid containers and systems using multiple backpressure chambers that provides a number of advantages not previously offered including 1) accommodating greater head pressures found in certain print heads; 2) allowing for larger fluid container design; and 3) reducing stranded fluid caused by uneven printing along a page wide print head. However, it is contemplated that the devices and methods disclosed herein may prove useful in addressing other deficiencies in a number of technical areas. Therefore the systems and devices disclosed herein should not be construed as addressing just the particular elements or deficiencies discussed herein.

The preceding description has been presented to illustrate and describe examples of the principles described. This description is not intended to be exhaustive or to limit these principles to any precise form disclosed. Many modifications and variations are possible in light of the above teaching.

What is claimed is:

1. A printer cartridge comprising:

multiple backpressure chambers in fluid communication with a shared free fluid chamber, a backpressure chamber to:

supply a fluid to nozzles of a portion of a fluidic ejection assembly; and provide backpressure to the nozzles of the fluidic ejection assembly during deposition of fluid onto a print medium.

2. The printer cartridge of claim 1, wherein the fluid is ink and the printer cartridge is an ink cartridge.

3. The printer cartridge of claim 1, wherein the multiple backpressure chambers are arranged in an array and the array is the same width as a print medium on which the fluid is deposited.

4. The printer cartridge of claim 1, wherein a backpressure chamber is independently regulated.

5. The printer cartridge of claim 1, wherein a backpressure chamber includes a foam insert disposed within the backpressure chamber to regulate the pressure of the backpressure chamber.

6. The printer cartridge of claim 5, wherein the foam insert, when full of fluid, seals a port between the backpressure chamber and the shared free fluid chamber.

7. The printer cartridge of claim 1, wherein a backpressure chamber includes a spring-compliant wall to regulate pressure within the backpressure chamber.

8. The printer cartridge of claim 1, further comprising a lid to prevent ink from exiting the backpressure chambers and the shared free fluid chamber.

9. The printer cartridge of claim 8, wherein the lid comprises passageways to limit water vapor loss.

10. The printer cartridge of claim 9, further comprising a film placed over the passageways.

11. A printer cartridge comprising:

a shared free fluid chamber;

a fluid delivery system in fluidic communication with the shared free fluid chamber to deliver fluid from the shared free fluid chamber to a fluid ejection assembly, the fluid delivery system comprising:

multiple backpressure chambers in fluid communication with the shared free fluid chamber to supply fluid to the fluidic ejection assembly and to provide backpressure to the fluid during deposition of the fluid onto a print medium, wherein a backpressure chamber comprises an outlet to pass fluid from the backpressure chamber to a corresponding portion of the fluidic ejection device; and multiple ports disposed between the shared free fluid chamber and the multiple backpressure chambers to regulate flow of fluid between the free fluid chamber and the multiple backpressure chambers.

12. The printer cartridge of claim 11, wherein the shared free fluid chamber is the same width as a print medium on which the fluid is deposited.

13. The printer cartridge of claim 11, wherein the multiple backpressure chambers are arranged in an array and the array is the same width as a print medium on which the fluid is deposited.

14. The printer cartridge of claim 11, wherein the printer cartridge is integrated with the printhead, the printhead comprising a number of print dies, each print die comprising number of nozzles to deposit an amount of fluid onto a print medium, each nozzle comprising:

a firing chamber to hold the amount of fluid;

an opening to dispense the amount of fluid onto the print medium; and an ejector to eject the amount of fluid through the opening.

15. The printer cartridge of claim 11, wherein a number of ports corresponds to a number of backpressure chambers with a port used for each backpressure chamber.

16. A fluid containment system comprising:

a number of printer cartridges, wherein each printer cartridge comprises:

a number of shared free fluid chambers; and multiple backpressure chambers, a set of backpressure chambers being in fluid communication with one of the number of shared free fluid chambers;

wherein a fluid containment device is the same width as a print medium on which fluid from the fluid containment device is deposited.

17. The fluid containment system of claim 16, wherein the set of backpressure chambers are separated from a corresponding shared free fluid chamber by a vertical wall.

18. The fluid containment system of claim 16, wherein at least one of the number of printer cartridges has a non-rectangular cross section.

19. The fluid containment system of claim 16, wherein different of the number of printer cartridges have different cross-sectional shapes.

20. The fluid containment system of claim 16, wherein different of the number of printer cartridges have different sizes.

* * * * *